United States Patent [19]

Wahl

[11] 3,935,042

[45] Jan. 27, 1976

[54] METHOD OF MANUFACTURING CORONA-RESISTANT ETHYLENE-PROPYLENE RUBBER INSULATED POWER CABLE, AND THE PRODUCT THEREOF

[75] Inventor: Ralph E. Wahl, Trumbull, Conn.

[73] Assignee: General Electric Company, New York, N.Y.

[22] Filed: Jan. 23, 1975

[21] Appl. No.: 543,335

Related U.S. Application Data

[62] Division of Ser. No. 486,523, July 8, 1974, Pat. No. 3,878,319.

[52] U.S. Cl. ..... 156/56; 174/110 AR; 174/120 SC; 427/118; 427/120; 427/388

[51] Int. Cl.[2] ..... H01B 9/02

[58] Field of Search ..... 156/51–56; 427/117–120, 314, 316, 372, 388, 409; 174/110 AR, 120 SC, 102 SC, 106 SC, 120 R, 110 R

[56] References Cited

UNITED STATES PATENTS

| | | | |
|---|---|---|---|
| 3,259,688 | 7/1966 | Towne et al. | 174/107 |
| 3,433,891 | 3/1969 | Zysk | 174/102 SC X |
| 3,472,692 | 10/1969 | Isshiki | 174/110 R X |
| 3,479,446 | 11/1969 | Arnaudin | 174/120 R |
| 3,541,228 | 11/1970 | Lombardi | 427/118 X |
| 3,748,369 | 7/1973 | Durakis et al. | 174/102 SC X |

*Primary Examiner*—Douglas J. Drummond
*Assistant Examiner*—David A. Simmons
*Attorney, Agent, or Firm*—Raymond G. Simkins; Philip L. Schlamp; Frank L. Nauhauser

[57] ABSTRACT

A method of manufacturing high voltage carrying electric power cable having a conductor insulated with a multilayered covering, and the cable product thereof. The cable construction includes a primary or dielectric insulating body of thermoset ethylene-propylene rubber and a thermoset jacket about the conductor, which is substantially free of corona-prone or ionization-prone voids and separations intermediate the layers. The method comprises forming and curing the ethylene-propylene rubber compound constituting the body of the primary or dielectric insulation around the conductor and then heat treating the thermoset-cured ethylene-propylene rubber insulation prior to applying subsequent components of the multilayered covering about the condutor, including an overlying semiconductive shielding layer and a protective enclosing jacket of heat-cured thermoset polymer. The semiconductive shielding layer overlying the body or primary of dielectric insulation around the conductor, comprises a combination of a highly vapor-permeable coating of semiconductive material adhered to the surface of the underlying body of insulation and a contiguous layer of semiconductive material superimposed over the coating adhered to the insulation.

15 Claims, 1 Drawing Figure

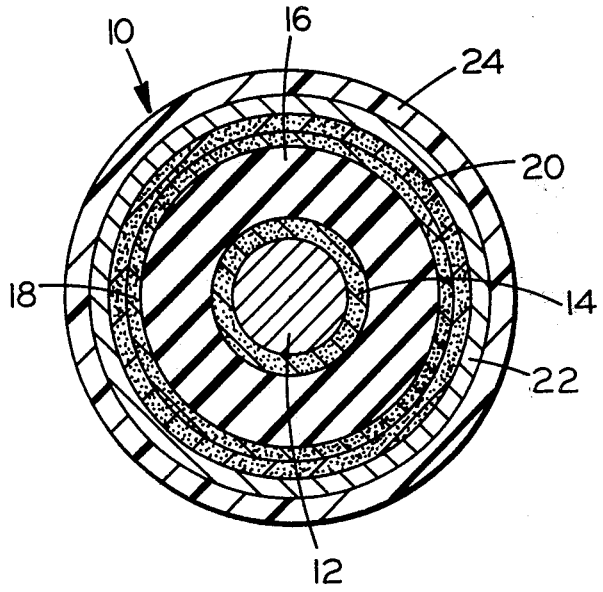
10
16
24
20
18
14
22
12

METHOD OF MANUFACTURING CORONA-RESISTANT ETHYLENE-PROPYLENE RUBBER INSULATED POWER CABLE, AND THE PRODUCT THEREOF

This is a division of application Ser. No. 486,523, filed July 8, 1974 now U.S. Pat. No. 3,878,319

BACKGROUND OF THE INVENTION

Higher-voltage carrying electric power cables, for example, cables carrying about 2000 or more volts, are conventionally constructed of an assemblage of a conductor with a multilayered insulating covering thereon, including a body of a primary or dielectric insulation, one or more layers of semiconductive shielding material immediately adjacent the body of insulation, and a protective enclosing jacket. Typical multilayered high-voltage carrying cables are shown, for example, in U.S. Pat. Nos:

| | | |
|---|---|---|
| 2,446,387 | 3,060,261 | 3,259,688 |
| 3,472,692 | 3,541,228 | 3,569,610 |
| 3,617,377 | 3,643,004 | 3,646,248 |
| 3,677,849 | 3,684,821 | 3,748,369 |
| 3,787,255 | 3,792,192 | |

and Canadian Pat. No. 740,093.

The occurrence or presence of voids within the primary insulation, or intermediate the insulation and an adjacent overlying or underlying semiconductive shielding body of the insulating coverings of such higher-voltage carrying cables, whether due to a separation or parting of component layers, or otherwise, often results in the generation of corona or ionization in the multilayered insulating covering during service, which in time is likely to cause a breakdown in the insulating covering and a failure of the cable. Coronaprone or ionization-prone separations or partings in multilayer covered electrical cable, as well as other gas formed pores or voids, commonly occur in such cable as the result of "outgassing" during manufacturing operations. The formation of such potentially debilitating voids due to outgassing is especially troublesome and critical in the production of cable wherein the manufacturing process includes exposure to high temperatures such as during heating operation to induce curing of thermosettable components or materials. Moreover, the presence of compositions which are prone to the formation of gases, such as thermosetting curable ethylene-propylene rubber compounds, increases the likelihood of void formation and related potential failure.

SUMMARY OF THE INVENTION

This invention comprises a combination of cable manufacturing conditions, cable construction and compositions therefor, for the manufacture of high voltage electric power cable having a conductor insulated with a multilayered covering, including a primary or dielectric insulating body of thermoset ethylene-propylene rubber compound, an overlying contiguous layer of semiconductive shielding, and a heat-cured, thermoset protective enclosing jacket. The invention enables the production of such cable in a manner which does not promote separations of, or a parting between, the layer of primary insulation and the immediate overlying shield, and as a result thereof the formation of intermediate voids or pores which are conducive to corona or ionization.

The invention further comprises a method wherein the body of thermosetting or curable ethylene-propylene rubber compound forming the primary or dielectric insulation for the conductor and a component of the composite insulating covering thereon, is subjected to a prolonged heat treatment following the completion of its cure through conventional means, and prior to the application or formation of overlying components or units of the assemblage constituting the composite covering. Additionally the invention entails the application and inclusion of a semiconductive coating of ingredients providing a highly vaporpermeable film extending over and securely adhered to the surface of the cured and heat treated body of ethylene-propylene rubber compound, and an adjoining overlying layer of semiconducting material superimposed on the coating.

The term ionization is used throughout this specification to define the same electrical phenomenon which is frequently referred to as "corona," or corona discharge or formation in the prior art patents and/or literature.

OBJECTS OF THE INVENTION

It is a primary object of this invention to provide a method of producing high voltage carrying electric power cable having a conductor insulated with a multilayered or composite covering which is not subject to a separation or parting of the layers or individual units of the composite and thus is not subject to ionization formation resulting from voids within the assemblage.

It is also an object of this invention to produce high voltage carrying electric power cable containing an assemblage of a primary or dielectric insulation of a body of cured ethylene-propylene rubber compound, a unit of semiconductive insulation shielding material and an enclosing protective jacket of cured polymeric material without the separations or partings of the insulation shield from the insulation.

It is a specific object of this invention to provide a method for the production of high voltage carrying electric cable including a body of primary or dielectric insulation comprising cured ethylene-propylene rubber compound and an overlying unit of semiconductive material comprising a vapor-permeable coating adhered to the surface of the cured body of insulation which effectively resists separation or parting therefrom and thus avoids the resultant occurrence of ionization-prone voids, and the product thereof.

It is additionally an object of this invention to provide a high voltage carrying electric cable product comprising a particular combination of components and materials, including a body of primary insulation and an insulation shield, which have been combined and treated in a specific manner whereby the product is effectively free of the presence of voids or open spaces between the primary insulation and its shield which would be a potential source of ionization.

BRIEF DESCRIPTION OF THE DRAWING

The drawing is a cross-sectional view of a multilayered cable construction of this invention.

DESCRIPTION OF A PREFERRED EMBODIMENT

This invention specifically deals with a high voltage carrying power cable having a conductor insulated with a multilayered covering or assemblage, including a primary or dielectric insulating body of cured or thermoset ethylene-propylene rubber composition, an overlying adjoining unit of semiconducting shielding material, and a protective enclosing jacket of a heat-cured polymeric material such as thermoset polychloroprene.

With reference to the drawing illustrating an electric power cable product 10, the method and construction of this invention comprises the following:

A metal conductor 12, which may be solid or stranded, can be provided with an optional inner shield of a layer 14 of semiconductive material, or other conventional components (not shown) such as a paper wrap or separating material located intermediate the conductor and the surrounding body of a primary or dielectric insulation 16. The inner shield can comprise a conventional semiconductive material such as a polymer composition filled with an electro-conductive ingredient comprising particulate metal or carbon black, and can be either applied as a fabric supported tape or extruded on as a continuum.

The body of primary or dielectric insulation 16, according to this invention, comprises a relatively thick layer of thermosetting curable ethylene-propylene rubber surrounding the conductor 12. The ethylene-propylene rubber can comprise a typical ethylene-propylene copolymer or terpolymer including any of the appropriate common curing systems comprising heat-activiated sulfurcontaining agents, organic peroxide-containing curing agents, and coagents therefor. Moreover, to insure the attainment of the optimum advantages and benefits of this invention, it is highly preferred that the ethylene-propylene rubber compound for the insulation be provided with a suitable peroxode curing agent in amounts within the approximate range of about 2.5 to about 3.5 parts of active peroxide material per 100 parts by weight of ethylene-propylene rubber. It is also preferred that the ethylene-propylene rubber compound be relatively free of highly volatile ingredients such as low molecular weight organic components.

Following the application of the body of curable ethylene-propylene rubber compound insulation around the conductor and curing thereof by conventional means, the formed and cured or thermoset ethylene-propylene rubber is heat treated to purge gases or sources thereof from its mass by prolonged exposure to high temperatures of at least about 200°F for a period in excess of about 12 hours. Temperatures within the approximate range of about 200°F to about 300°F for periods of between about 12 to about 98 hours are preferred. The heat treatment is carried out with a substantial amount of the surface of the cured or thermoset ethylene-propylene rubber compound exposed to the surrounding atmosphere to encourage the emanation and dissipation of any gases therefrom.

According to this invention, the adjoining insulation shielding unit of semiconductive material overlying the surface of the body of insulation comprises two distinct phases including a coating 18 having semiconductive properties adhered to the surface of the body of insulation and a contiguous layer 20 of semiconductive composition superimposed over the coating 18.

Coating 18, which covers and is adhered to the surface of the underlying body of insulation, consists of a highly vapor-permeable film comprising a polymeric material containing an electro-conductive filler, such as an ethylene-containing polymer or copolymer with a filler of particulate metal or carbon black. The coating is applied by any suitable manner such dipping, spraying, flooding or wiping a solution and/or dispersion thereof in an apt solvent or liquid medium, on the surface of the cured and heat-purged body of insulation. A suitable coating material comprises, for example, a copolymer of ethylene-vinyl acetate and carbon black dispersed in a medium of trichloroethane.

Semiconductive layer 20 comprises a blend of elastomeric material with electro-conductive filler which can be applied over the coating 18 either by extrusion molding of a surrounding continuum or as a wrapping of a tape containing the components thereof. Semiconductive layer 20 can comprise a commercial electrical tape having semiconductive properties composed, for example, of a nylon polyamide or other textile fabric, scrim, or stranded foundation, impregnated or coated with butyl rubber or other suitable elastomer containing electro-conductive filler such as particulate metal or carbon black. Suitable tapes for use in this invention are commercially available from vendors including Chase & Sons, Inc., Plymouth Rubber Co. Inc., and Haartz-Mason, Inc.

It is to be understood that in the semiconductive components of the construction or assemblage for cable 10, the amounts of electro-conductive filler in proportion to polymeric carrying material or matrix, depends upon cable designs including service voltages, the dimensions of the respective components, and the electrical properties of the particular fillers and polymeric materials employed, among other possible factors appreciated by those akilled in the art.

In the preferred embodiment illustrated in the drawing for a cable 10 of this invention, a layer of shielding drain or ground 22 comprising strands of metal such as tape or wire are positioned over the composite insulation shield unit of semiconductive materials composed of coating 18 and contiguous layer 20. A typical drain or ground shield 22 consists of copper or aluminum tapes, or wires, wrapped helically about or otherwise fixed along the length of the assembly in contact with semiconducting layer 20.

Enclosing the overall cable 10 construction or the multilayered assembly about the conductor 12, is a protective jacket 24 or sheath comprising a heat-cured or thermoset polymeric material such as a polychloroprenechlorosulfonated polyethylene, butadiene-acrylonitrile and polyvinyl chloride blends, butyl rubber, polyethylene, and the like. An optional separator of cloth, paper or plastic film can be placed between the metal shield 22 and the overlying polymeric jacket 24 to prevent adhesion and/or penetration of the polymeric material with respect to the metal shield.

In addition to the heat purging of gases or potential volatiles from the mass of the cured body of ethylene-propylene rubber compound insulation 16 described above, a further essential feature of this invention with respect to deterring separations or a parting of the semiconductive insulation shield from the insulation with the resultant formation of detrimental corona or ionization prone voids, is the unique construction and nature of the outer insulation shield unit comprising a semiconductive composite of the coating 18 and contiguous layer 20. This aspect of the invention comprises the formation or introduction of a coating of semiconductive material which is highly permeable to vapors and also is securely adhered to the surface of the underlying body of primary insulation 16 with a bonding strength effectively greater than does occur between this coating and the overlying contiguous layer 20 of semiconductive tape or extrudate. Thus upon the emanation of any gases from the mass of the cured ethylene-propylene rubber compound insulation which have not previously been expelled by the purging heat treatment, attributable to heat from subsequent manufacturing steps such as curing the applied thermosetting protective jacket, or whatever source or cause, the emanating gases readily permeate or diffuse through the coating 18 which is securely adhered to the surface of the underlying gas emitting insulation rather than causing a parting or separation therebetween at their interface. Moreover, although the gases may not as easily pass through subsequent layers or units of denser or less permeable consistency, such as layer 20 of the contiguous semiconductive material, the possible formation of a void due to a parting or separation of semiconductive layer 20 from semiconductive coating 18 does not result in development of corona or ionization because the area of such a void or pore is effectively surrounded and protected by semiconducting material.

An illustration of a specific embodiment of all aspects of this invention, comprising the method and product thereof, is provided by the following example along with the indicated ionization properties thereof in relation to the same properties of similar cable products outside the scope of this invention.

Following the application of a strand or inner shield of semiconductive material composed of a carbon black filled ethylene-vinyl acetate copolymer extruded around a copper conductor, a body of primary or dielectric insulation approximately one-fourth of an inch thick and of the below-identified composition, was continuously formed by extrusion around the taped conductor. The ethylene-propylene rubber compound constituted the given ingredients in approximate parts by weight:

| | Parts By Weight |
|---|---|
| Ethylene-propylene rubber copolymer Vistalon 404, Enjay | 45.15 |
| Clay filler | 43.19 |
| Zinc oxide | 1.35 |
| Lead dioxide | 0.90 |
| Polytrimethyldihydroquinoline antioxidant Flectol H, Monsanto | 0.90 |
| Petrolatum | 2.26 |
| Polybutadiene homopolymer coagent Ricon 150 | 2.26 |
| Vinyl silane | 0.68 |
| Dicumyl peroxide curing agent 40% active - DiCup 40KE, Hercules | 3.30 |

The extruded insulating body of the aforesaid composition was cured to a thermoset condition by exposure to a temperature of about 406°F over a dwell period of about five minutes. Thereafter, the cured ethylene-propylene rubber compound insulation was subjected to a heat-treatment of approximately 239°F for 60 hours while the length of the unit thereof was wound with its convolutions or coils separated in a spaced pattern providing a high degree of access of the surface to the ambient atmosphere to expedite the purging of any internal gases.

Next a coating composition comprising approximately 39 parts by weight of ethylene-vinyl acetate copolymer and approximately 59 parts by weight of carbon black dispersed in about 465 parts by weight of trichloroethane, was applied by saturating the surface of the cured and heat treated ethylene-propylene insulation and wiping off the excess.

A helical wrapping of semiconductive tape with overlapping edges was applied over the coating. The tape was a commercial electrical tape comprising a nylon polyamide fabric impregnated with butyl rubber containing carbon black.

A wrapping of copper strips was then applied over the semiconductive composite of the coating and tape to provide a drain or ground shield. A protective jacket enclosing the overall cable construction was extruded over the composite assemblage with a curable polychloroprene (neoprene) compound and thereafter cured at about 200°F for approximately 10 hours. The thermosetting curable polychloroprene composition consisted of in parts by weight:

| | Parts By Weight |
|---|---|
| Polychloroprene Neoprene Type W, duPont | 100.00 |
| Carbon black | 40.70 |
| Clay | 48.60 |
| Oil - Sundex 790 | 15.12 |
| Anti-chek wax, Sunoco | 2.91 |
| Plasticizer Millrex, Malrex Chemicals Co. | 2.33 |
| Phenyl-beta-naphthylamine Neozone D, duPont | 2.09 |
| Red lead | 16.28 |
| Petrolatum | 2.26 |
| Dispersion of ethylenethiourea in stearic acid and wax 5432-25 (Pre-dispersed acceleration) Ware Chemical Co. | 2.28 |

Exemplary samples of the cable produced by the foregoing method and construction of this invention, designate Examples I–IV, were tested for ionization according to the Insulated Power Cable Engineers Associated test S-68-516 Interim Standard No. 1 dated March, 1971, and the ionization data derived from the tests were compared with respect to ionization data from samples of Standards composed of similarly constructed cables of the same capacity which did not contain a composite insulation shield unit of semiconductive coating adhered to the primary insulation combined with a contiguous layer of semiconductive material.

The Standards of A, B and C comprised samples of the same cable construction as the Examples of this invention, except for the omission therefrom of the coating 18 having semiconductive properties adhered to the surface of the body of insulation 16, and wherein the manufacturing heat treatment of the same intensity and time as the Examples was carried out with the material wound on a reel in a normal manner with the convolutions in a contiguous relationship. The Standards of D and E comprised samples of the same cable construction as the Examples of this invention, namely, including coating 18 described above, which were subjected to the same manufacturing heat treatment under the conditions applied in Standards A, B & C, that is with the material wound on a reel in a normal manner with the convolutions in a contiguous relationship.

The cable specifications for the samples of the Examples and Standards, and their ionization properties are all given in the following table.

| Examples | Conductor Size AWG | Voltage Capacity KV | Ionization Level Minimum Required | Test |
|---|---|---|---|---|
| I | 1000 | 15 | 15 | 33 |
| II | 4/0 | 15 | 15 | 32.3 |
| III | 4/0 | 15 | 15 | 23 |
| IV | 500 | 15 | 11 | 19.1 |

-continued

| Examples | Conductor Size AWG | Voltage Capacity KV | Ionization Level Minimum Required | Test |
|---|---|---|---|---|
| Standards | | | | |
| A | 4/0 | 15 | 15 | 11.7 |
| B | 4/0 | 15 | 15 | 11 |
| C | 4/0 | 15 | 15 | 10.8 |
| D | 4/0 | 15 | 15 | 15 |
| E | 4/0 | 15 | 15 | 15 |

In the preferred embodiment of this invention, ionization properties of approximately twice the required minimum are provided. Also, the cable construction of this invention produces a cable which meets the minimum requirement regardless of circumstances of performing the heat treatment, as demonstrated by Standards D and E.

What I claim as new and desire to secure by Letters Patent of the United States is:

1. A method of manufacturing electric power cable comprising an assemblage of a conductor with a composite covering thereabout including a dielectric insulation of a thermoset ethylene-propylene rubber compound, a semiconductive layer overlying the dielectric insulation, and an enclosing jacket of a thermoset polychloroprene, comprising the steps of:

a. forming a dielectric insulating body of a curable ethylene-propylene rubber compound about a metallic electrical conductor, and curing the ethylene-propylene rubber of said insulating body;

b. heating the cured ethylene-propylene rubber compound insulating body about the conductor to a temperature of at least about 200°F;

c. applying a vapor-permeable, semiconductive adhering coating over the surface of said cured and heated insulating body of ethylene-propylene rubber compound;

d. applying a layer of semiconductive material overlying the coating adhered to the surface of the cured and heated insulating body; and e. forming an enclosing protective jacket of a heat-curable polymer surrounding the cable assemblage and heat curing the polymer.

2. A method of manufacturing electrical power cable comprising an assemblage of a conductor with a composite covering thereabout including a dielectric insulation of a thermoset ethylene-propylene rubber compound, a semiconductive layer overlying the dielectric insulation, and an enclosing jacket of a thermoset polychloroprene, comprising the steps of:

a. forming a dielectric insulating body of a curable ethylene-propylene rubber compound about a metallic electrical conductor, and curing the ethylene-propylene rubber of said insulating body;

b. heating the cured ethylene-propylene rubber compound insulating body about the conductor to a temperature of about 200°F to about 300°F for a period of at least about 12 hours;

c. applying a vapor-permeable, semiconductive adhering coating over the surface of the cured and heated insulating body of the ethylene-propylene rubber compound;

d. applying a layer of semiconductive material overlying the coating adhered to the surface of the cured and heated insulating body; and e. forming an enclosing protective jacket of a heat-curable polymer surrounding the cable assemblage, and heat curing the polymer.

3. The method of manufacturing electric power cable of claim 2, wherein the cured ethylene-propylene rubber compound insulating body is heated to a temperature of about 200°F to about 300°F for a period of about 24 hours to about 98 hours.

4. The method of manufacturing electrical power cable of claim 3, wherein the layer of semiconductive material overlying the coating adhered to the surface of the insulating body comprises a fabric impregnated with an elastomer containing an electro-conductive filler.

5. A method of manufacturing electric power cable comprising an assemblage of a conductor with a composite covering thereabout including a dielectric insulation of a thermoset ethylene-propylene rubber compound, a semiconductive layer overlying the dielectric insulation, and an enclosing jacket of a thermoset polychloroprene, comprising the steps of:

a. forming a dielectric insulating body of a curable ethylene-propylene rubber compound about a metallic electrical conductor, and curing the ethylene-propylene rubber of said insulating body;

b. heating the cured ethylene-propylene rubber compound insulating body about the conductor to a temperature of at least about 200°F for a period of at least about 12 hours;

c. applying a vapor-permeable, adhering coating comprising an ethylene-containing polymer and electro-conductive filler dispersed in a volatile solvent for the polymer over the surface of the cured and heated insulating body of ethylene-propylene rubber compound;

d. applying a layer of semiconductive material overlying the coating adhered to the surface of the cured and heated insulating body; and e. forming an enclosing protective jacket of a heat-curable polymer surrounding the cable assemblage and heat curing the polymer.

6. The method of manufacturing electrical power cable of claim 5, wherein the cured ethylene-propylene rubber compound insulating body is heated to a temperature of about 200°F to about 300°F for a period of about 24 hours to about 98 hours.

7. The method of manufacturing electrical power cable of claim 6, wherein the layer of semiconductive material applied over the coating adhered to the surface of the cured and heated insulating body comprises a fabric impregnated with an elastomer containing an electro-conductive filler.

8. The method of manufacturing electrical power cable of claim 7, wherein the vapor-permeable coating adhered to the surface of the insulating body comprises a copolymer of ethylene-vinyl acetate and carbon black filler.

9. A method of manufacturing electric power cable comprising an assemblage of a conductor with a composite covering thereabout including a dielectric insulation of a thermoset ethylene-propylene rubber compound, a semiconductive layer overlying the dielectric insulation, and an enclosing jacket of a thermoset polychloroprene, comprising the steps of:

a. forming a dielectric insulating body of a curable ethylene-propylene rubber compound about a metallic electrical conductor, and curing the ethylene-propylene rubber of said insulating body;

b. heating the cured ethylene-propylene rubber compound insulating body about the conductor to a temperature of about 200°F to about 300°F for a period of at least about 24 hours;

c. applying a vapor-permeable, adhering coating comprising a polymeric material and an electro-conductive filler over the surface of the cured and heated insulating body of ethylene-propylene rubber compound;

d. applying a layer of semiconductive material overlying the coating adhered to the surface of the cured and heated insulating body; and e. forming an enclosing protective jacket of a curable polychloroprene surrounding the cable assemblage and heat curing the polychloroprene.

10. The method of manufacturing electrical power cable of claim 9, wherein the layer of semiconductive material comprises a nylon polyamide fabric impregnated with butyl rubber.

11. The method of manufacturing electrical power cable of claim 10, wherein the vapor-permeable, adhering coating comprising and ethylene-containing polymer and electro-conductive filler dispersed in a volatile solvent for the polymer, and is applied over the surface of the cured and heated insulating body of ethylene-propylene rubber whereby it resides intermediate said surface and the layer of overlying semiconductive material.

12. A method of manufacturing electrical power cable comprising an assemblage of a conductor with a composite covering thereabout including a dielectric insulation of a thermoset ethylene-propylene rubber compound, a semiconductive layer overlying the dielectric insulation, and an enclosing jacket of a thermoset polychloroprene, comprising the steps of:

a. preparing a curable ethylene-propylene rubber compound containing about 2.5 to about 3.5 parts by weight of peroxide curing agent per 100 parts by weight of ethylene-propylene rubber and up to about 8 parts by weight of petrolatum per 100 parts by weight of ethylene-propylene rubber, forming a dielectric insulating body of said curable ethylene-propylene rubber compound about a metallic electrical conductor and curing the ethylene-propylene rubber of said insulating body;

b. heating the cured ethylene-propylene rubber compound insulating body about the conductor to a temperature of at least about 200°F for a period of at least about 24 hours;

c. applying a vapor-permeable coating comprising an ethylenecontaining polymer and electro-conductive filler dispersed in a volatile solvent for the polymer over the surface of the cured and heated insulating body of ethylene-propylene rubber compound;

d. applying a layer of semiconductive material overlying the coated surface of the cured and heated insulating body; and e. forming an enclosing protective jacket of a curable polychloroprene surrounding the cable assemblage and heat curing the polychloroprene.

13. The method of manufacturing electrical power cable of claim 12, wherein the cured ethylene-propylene rubber compound insulating body is heated to a temperature of about 200°F to about 300°F for a period of about 24 hours to about 98 hours.

14. The method of manufacturing electrical power cable of claim 13, wherein the vapor-permeable coating comprises a copolymer of ethylene-vinyl acetate and carbon black filler.

15. The method of manufacturing electrical power cable of claim 14, wherein the layer of semiconductive material applied over the coated surface of the cured and heated insulated body comprises a nylon polyamide fabric impregnated with a butyl rubber elastomer containing carbon black filler.

* * * * *